United States Patent [19]

Amberson

[11] Patent Number: 4,478,892

[45] Date of Patent: Oct. 23, 1984

[54] METHOD OF AND APPARATUS FOR HOT DIP COATING OF STEEL STRIP

[75] Inventor: Paul E. Amberson, Valparaiso, Ind.

[73] Assignee: National Steel Corporation, Pittsburgh, Pa.

[21] Appl. No.: 475,895

[22] Filed: Mar. 16, 1983

[51] Int. Cl.[3] ..... B05D 3/02; B05C 3/12

[52] U.S. Cl. ..... 427/320; 427/321; 427/319; 427/432; 118/61; 118/419

[58] Field of Search ..... 427/329, 321, 432, 345, 427/320, 319; 118/61, 419

[56] References Cited

U.S. PATENT DOCUMENTS

| | | | |
|---|---|---|---|
| 2,570,906 | 10/1951 | Alferieff . | |
| 2,881,514 | 4/1959 | Drummond . | |
| 3,051,587 | 8/1962 | Coburn . | |
| 3,728,144 | 4/1973 | Poucke | 427/432 |
| 4,053,661 | 10/1977 | Caldwell et al. | 427/320 |
| 4,123,291 | 10/1978 | Arnold et al. | 148/6.35 |
| 4,172,911 | 10/1979 | Michels | 427/300 |
| 4,183,983 | 1/1980 | Cook | 427/321 |

FOREIGN PATENT DOCUMENTS

| | | | |
|---|---|---|---|
| 4025097 | 6/1974 | Japan | 427/329 |

*Primary Examiner*—Sam Silverberg
*Attorney, Agent, or Firm*—O'Neil & Bean

[57] ABSTRACT

An improved method of and apparatus for hot dip metal coating of steel strip in which the strip is heated and cleaned in a furnace then passed through a protective hood containing a reducing gas and into the molten coating metal bath. Coating metal oxides evolved in the hood are removed by flowing a nonoxidizing gas across the surface of the coating metal in the hood and withdrawing the gas and entrained oxides from a location in the vicinity of the coating metal surface. The oxides are removed from the withdrawn gas, and the gas returned to be again flowed across the coating metal surface.

17 Claims, 5 Drawing Figures

10
12
14
16
18
20
22
23
24
26
28
30
32
34
36
38
40
42
44
46
50
52
56
58

METHOD OF AND APPARATUS FOR HOT DIP COATING OF STEEL STRIP

BACKGROUND OF THE INVENTION

1. The Field of the Invention

This invention relates to hot dip metallic coating of ferrous strand, and more particularly to the continuous hot dip coating of ferrous strand such as steel strip and wire with molten zinc or an alloy of zinc and other metals such as aluminum.

2. Description of the Prior Art

In the continuous hot dip metallic coating of ferrous strand including steel strip, sheet stock, and wire, hereinafter generally referred to as strip, the strip is treated in a furnace to provide a clean surface substantially free of oxide scale and other surface contamination so as to be readily wettable by the molten coating metal. The strip normally passes through an enclosed protective hood which extends from the treatment furnace and terminates in a snout having an open end projecting below the surface of the molten coating metal. The clean, treated strip passing through the hood is maintained at a temperature substantially equal to the temperature of the molten coating metal bath, and a reducing atmosphere such as a mixture of hydrogen and nitrogen is maintained in the hood to prevent the formation of oxides on the steel surface between the furnace and the coating bath.

When the coating metal is zinc, or an alloy comprising a substantial proportion of zinc, oxide vapors are evolved above the surface of the coating metal within the hood snout despite the reducing atmosphere maintained in the hood. Solid oxides of the coating metal tend to precipitate from the oxide vapor in the snout and the precipitated oxide may be deposited as a white powdery material on the surface of the coating bath or directly onto the surface of the hot strip entering the bath. The small particles of oxide adhering to the strip can result in a defective coating by preventing the coating material from adhering to the metal surface. For example, a particle of zinc oxide on the surface of a strip passing between the strip and the sink roll in the coating metal pot will tend to be crushed and prevent adherence of the coating metal over an area greater than the original size of the particle. Thus, it is desirable to remove the oxide containing vapors from the hood snout before it can precipitate in solid form.

The problem caused by coating metal oxides in hot dip coating steel strip with a zinc-aluminum alloy are discussed in U.S. Pat. No. 4,053,663. This patent also proposes to solve the problem by directing the reducing atmosphere gas consisting of a mixture of nitrogen and hydrogen gases into the hood so as to cause the gas to flow across the surface of the coating metal toward the steel strip from both sides, then upward along the strip. The reducing gas was preheated to about 1000° F. before being introduced into the hood. Up to 24,000CFH were caused to sweep across the coating metal and flow countercurrent to the strip in the hood.

Applicant has discovered that directing large volumes of gas over the surface of the coating metal and against the surface of the strip can cause oxide particles to adhere to the surface to be coated. Further, the oxide vapors evolved in the hood of this prior art patent are retained in the hood and swept along the surface of the steel strip from the coating metal surface to the treatment furnace. However, in accordance with the present invention, the oxide vapors are removed from the protective hood before substantial quantities of the oxides precipitate as solids.

It is a primary object of the present invention to provide a method of and an apparatus for effectively and efficiently removing the coating metal oxide vapors evolved in the protective hood above the molten metal surface in a hot dip metal coating operation.

Another object of the invention is to provide an improved method and apparatus for withdrawing reducing atmosphere gas and coating metal oxide containing vapors from an outlet in the hood snout at a location near the surface of the coating metal, and to simultaneously introduce a nonoxidizing gas into the hood snout at a point to cause a flow of gas across the coating metal surface within the snout in the direction of the outlet to sweep coating metal oxide containing vapors from within the hood snout.

Another object of the invention is to provide an improved method of and apparatus for withdrawing coating metal oxide containing vapors and reducing atmosphere gas from the hood snout in a hot dip steel strand coating operation, removing the metal oxide from the vapors and reducing atmosphere gas removed from the snout, and reintroducing the oxide free gas into the hood snout.

SUMMARY OF THE INVENTION

In the attainment of the foregoing and other objects and advantages of the invention, an important feature resides in providing an oxide filter trap having an inlet and an outlet, and connecting the filter trap inlet to an outlet in the hood snout at a location near the surface of the coating metal on one side of the snout and connecting the outlet of the filter trap to an inlet in the hood snout at a location near the coating metal surface and substantially opposed to the hood outlet. Means is provided to induce a flow of coating metal oxide containing vapor and reducing atmosphere gas from the snout outlet through the filter trap and back into the snout through the hood inlet. The flow rate through the hood inlet and the location of the hood inlet and outlet are such as to produce a flow of gas across the surface of the coating metal within the snout to sweep coating metal oxide containing vapors toward the outlet to be drawn into the filter trap for removal. Flow through the filter trap can be induced by introducing a nonoxidizing gas, for example nitrogen gas, under pressure, in the line connecting the filter trap to the hood inlet so as to increase the velocity in this line in the direction of the snout inlet to thereby produce a suction, by an aspiration effect, through the filter trap.

The filter trap is mounted closely adjacent the top of the molten coating metal pot and includes a rigid closed housing defining an enlarged open precipitation section having a plurality of baffles arranged therein to reduce the flow rate and provide a tortuous flow path from its inlet to its outlet, and a filter section adjacent the outlet. The filter section may comprise a filter element made up of a coarse steel wool which acts to remove any coating metal oxide not removed in the precipitation section of the filter trap.

BRIEF DESCRIPTION OF THE DRAWINGS

Other features and advantages of the invention will become apparent from the detailed description contained hereinbelow, taken in conjunction with the drawings, in which.

DESCRIPTION OF THE PREFERRED EMBODIMENTS

Figures 1, 2:
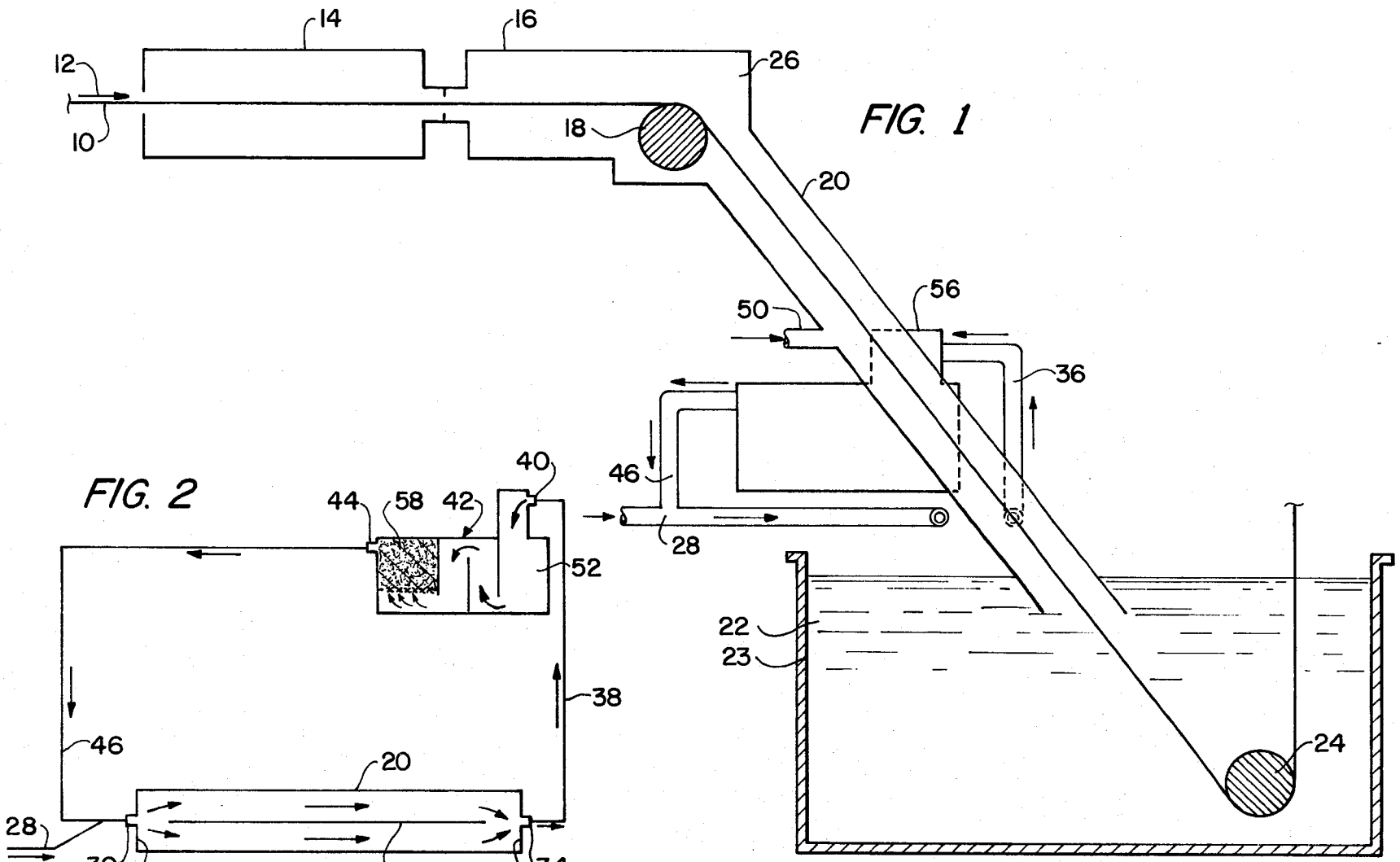
FIG. 1 is a schematic view illustrating portions of a hot dip galvanizing apparatus embodying the present invention.
FIG. 2 is a schematic illustration of the oxide vapor conduit and filtering system used in the apparatus of FIG. 1.

Referring first to FIG. 1, a steel strip to be coated, for example by a hot dip galvanizing operation is designated generally by the reference numeral 10 and is moved in the direction of arrow 12 through conventional cleaning and annealing furnace apparatus designated generally by the reference numeral 14. From the furnace 14, the heated, cleaned strip is passed through a protective hood 16 containing a controlled atmosphere, typically a reducing atmosphere consisting of a mixture of nitrogen and hydrogen, and directed by guide roll 18 downwardly through a snout portion 20 of the hood having an open bottom end disposed beneath the surface of the molten coating metal bath 22 in tank 23. The strip passes beneath sink roll 24 in tank 23, then upwardly and out of the bath for further processing in accordance with conventional procedure. For example, air knives located above the top surface of the molten coating metal bath may be provided to control the thickness of coating metal as illustrated, for example, in U.S. Pat. No. 3,499,418.

Although the reducing gas atmosphere maintained within the protective hood and snout effectively prevents oxidation of the cleaned, treated steel strip surface before entering the coating metal bath 22, trace amounts of oxygen in the reducing gas and in the coating metal bath are sufficient to produce some oxidation of the coating metal within the snout. The coating metal oxides are initially evolved principally in vaporous form adjacent to the bath surface. As the oxides condense and precipitate in solid form, they can be picked up on the surface of the strip and be carried through the metal coating bath and result in pinhole or bare spot defects of the surface of the coated metal.

In accordance with the present invention, adverse effects of coating metal oxide evolved within the hood snout are avoided by removing the oxide vapors from the vicinity of the coating metal surface before the oxides precipitate in solid form on the coating metal surface or on the steel strip. This is accomplished without requiring treatment of the reducing gas atmosphere admitted to the hood.

In accordance with the present invention, a separate nonoxidizing gas, preferably nitrogen gas, is introduced into the protective hood snout near the surface of the coating metal bath and is caused to flow across the surface of the metal bath within the snout in a direction generally parallel to the face surfaces and transversely of the direction of movement of the steel strip through the snout. The nonoxidizing gas (flushing gas) used to flush the oxide vapors from the snout is withdrawn from the snout from an outlet located near the coating metal surface and passed through an oxide metal filter trap before being reintroduced into the snout to again sweep across the coating metal surface.

Figure 4:
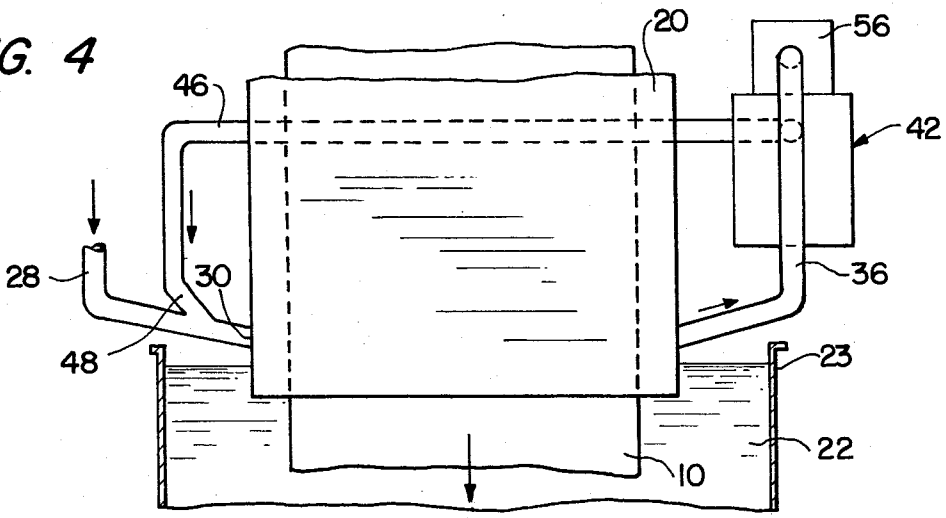
FIG. 4 is an end elevational view taken of the structure shown in FIG. 3.

Referring to the schematic flow diagram of FIG. 2, flushing gas is supplied from a suitable source, not shown, through a conduit 28 and admitted through inlet 30 located substantially in the center of one side edge wall 32 of hood snout 20. The flushing gas flows transversely of the steel strip 10 on both sides thereof and exits through an oxide outlet 34 in the side wall 36 which is substantially opposite to wall 32. As best seen in FIG. 4, flushing gas inlet 30 is located in wall 32 in the vicinity of the surface of the molten coating fluid 22, with the inlet being inclined downwardly so that flushing gas flowing through the inlet sweeps across the surface of the coating metal to pick up and entrain vaporous metal oxides evolved from the coating metal and sweep them from the path of the moving steel strip 10 toward the oxide outlet 34.

Coating metal oxide vapors and/or small particles of solid oxide entrained in the flushing gas are continuously withdrawn through outlet 34 and lead through conduit 38 to the inlet 40 of an oxide condensing trap and filter assembly designated generally by the reference numeral 42. The coating metal oxide vapors are condensed and retained in the filter trap 42 while the flushing gases are drawn from the filter outlet 44 to be returned through conduit 46 to the inlet 30 to be recirculated through the system. The pressurized flushing gas supply conduit 28 and filter exhaust gas conduit 46 are connected together adjacent inlet 32 by a "Y" fitting 48 which acts as a venturi, enabling pressurized flushing gas flowing through conduit 28 to apply a suction, by an aspiration effect, to the conduit 46 to produce a continuous flow of gas and oxides through the outlet 34 and filter trap 42 to continuously withdraw vaporous and/or solid coating metal oxides for removal by the filter trap 42. As indicated schematically in FIG. 1, the conventional reducing atmosphere gas is also continuously admitted into the snout portion 20 of the protective hood through an atmosphere gas inlet 50 located above inlet 30 and outlet 34.

The flushing gas withdrawn through outlet 34 passes through filter trap 42 and, after having the entrained coating metal oxides condensed and removed, is returned to flushing gas inlet 32 and mixed with the pressurized flushing gas from conduit 28. Thus, it is apparent that a portion of the flushing gas introduced into the snout is mixed with the reducing atmosphere gas in the snout and moves upwardly through the hood and furnace structure for ultimate removal in the conventional manner. However, by maintaining a continuous, relatively low velocity flow of recirculated and make-up flushing gases across the bottom end portion of the snout enclosure above the surface of the coating metal, the coating metal oxides are effectively removed before they have an opportunity to precipitate as solids and be attached to the moving steel strip entering the coating metal bath. In practice, the make-up flushing gas line 28 may be a one inch diameter pipe, with nitrogen gas supplied through the pipe to the "Y" fitting 48 at a pressure of about 4.5 psig. The return conduit 46 and inlet 30 may be two inches in diameter. Thus, it is apparent that a relatively low volume of flushing gas is required to induce a flow through the filter system and effectively remove coating metal oxides from the chamber 26 in the bottom portion of the snout 20.

Figure 5:
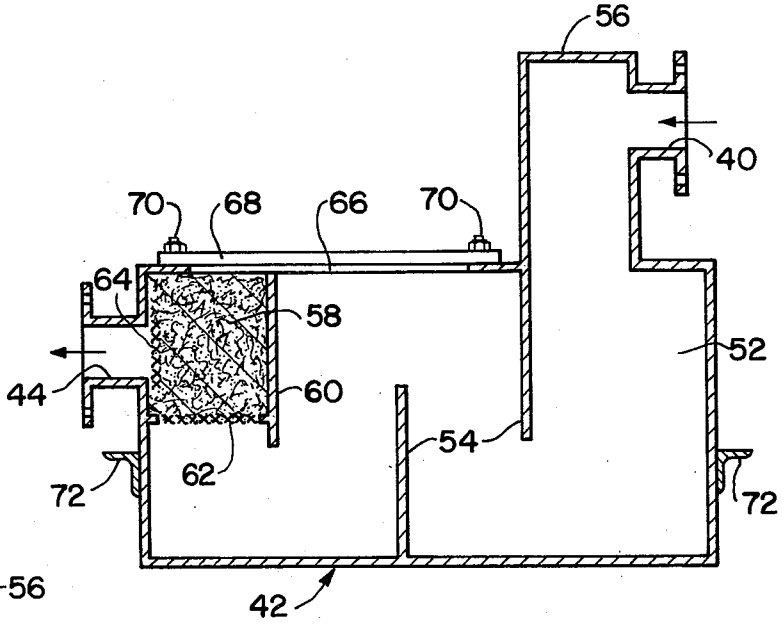
FIG. 5 is a longitudinal sectional view taken on line 5—5 of FIG. 3 showing the construction of a filter trap employed in the invention.
Figure 3:
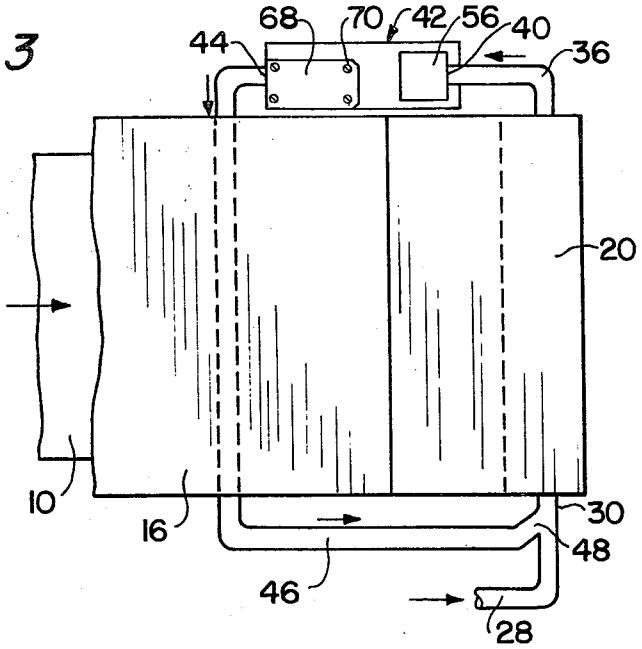
FIG. 3 is a top plan view of a portion of the structure shown in FIG. 1.

The filter trap 42, shown in section in FIG. 5, preferably comprises a rigid, substantially rectangular welded steel housing defining a relatively large condensing and settling chamber 52 through which the flushing gases and coating fluid oxides move at a relatively low velocity to enhance precipitation and a settling of the oxides. A plurality of baffle walls 54 rigidly mounted in the chamber 52 provides a tortuous path for gas flowing through the filter trap to assure maximum retention time of all of the gases flowing therethrough from the inlet 40 located in an upwardly projecting extension 56 of the filter trap housing and the outlet 44 located at the opposite end of the housing. A body of filter material 58, preferably a mass of relatively coarse steel wool, is supported between the baffle wall 60 and outlet 44 so that all gas passing through the filter trap must pass through the filter mass 58. The steel wool filter material 58 may be supported on a section of expanded steel sheet material 62 mounted between baffle wall 60 and the end wall of the filter trap housing, and a second section of expanded steel sheet 64 preferably is fixed over the outlet 44.

An opening 66 in the top wall of the filter trap housing provides access to the chamber 52 and to the filter mass 58 for servicing of the filter and to enable removal of precipitated oxides from the filter trap. A cover plate 68 extends over and closes opening 66, and is retained in position by a plurality of threaded pastures 70. Suitable mounting brackets 72 are provided on the filter trap housing to facilitate mounting the assembly adjacent one side edge of the snout 20 above the top of the tank 23.

In one embodiment of the invention which has been constructed and successfully operated, the conduit 36 leading to the inlet 40 of the filter trap is a four inch pipe whereas the flushing gas return pipe 46 is a two inch pipe. Flushing gas make-up pipe 28 is a one inch pipe, with the nitrogen pressure being maintained in the make-up pipe at about 4 to 5 psig. Experimentation has shown that, with the physical construction of the filter system described, when mounted on a commercial hot dip galvanizing line for coating steel strip with zinc, or with an alloy of zinc and aluminum, oxide vapors are effectively removed from the snout and precipitated or filtered from the flushing gas by the filter trap when make-up nitrogen gas is supplied at a pressure above about 4 psig. Pressures substantially in excess of 4.5 psig did not appear to produce any improved results and the amount of coating metal oxide retained in the filter trap was substantially the same when nitrogen gas in the one inch flushing gas make-up line was supplied at 4.5 and at 6 psig. When attempts were also made to reduce the amount of flushing gas used, the amount of oxide retained in the filter trap decreased when the flushing gas pressure was reduced below about 4 psig and the system was considered ineffective when 1.5 psig of flushing gas was attempted. It should be apparent, however, that the gas pressures required to produce an effective flow rate through the hood would vary with the geometry of the system.

Although it is apparent that the flow rate of the flushing gas across the surface of the coating metal within the snout must be maintained above some critical level, it has been found that a surprisingly low volume of make-up gas is required while using the system described. This low volume and the consequent low velocity of gas across the surface of the steel strip being coated, with the flow being substantially parallel to the surfaces of the steel strip and perpendicular to its direction of movement, is extremely effective in avoiding the deposit of coating metal oxides on the strip, with the result that a substantially improved coated steel product is produced.

While a specific embodiment of the invention has been disclosed and described, it is believed apparent that various modifications may be made. For example, reducing atmosphere gas could be withdrawn from the oxide outlet and passed through the filter trap to remove the oxides, then returned by a suitable gas pump means to flow across the coating metal surface so that a separate source of flushing gas would not be required. Thus, it should be understood that the invention is not restricted to the disclosed embodiment and it is intended to include all embodiments of the invention which would be apparent to one skilled in the art and which come within the spirit and scope of the invention.

What is claimed is:

1. In a method of hot dip coating a running length of a steel strip with a metal coating, wherein the steel strip is moved from a heating furnace into a molten bath of the coating metal through a protective atmosphere contained in an enclosed hood having a snout terminating in an open outlet positioned below the surface of the molten bath of coating metal, the improvement comprising, directing a flow of nonoxidizing flushing gas across the surface of the molten coating metal within the snout on both sides of the strip in a direction generally parallel to its face surfaces and transverse to its direction of movement by admitting the gas into the hood snout through an inlet located at one side of the snout in the vicinity of the surface of the molten coating metal, and simultaneously withdrawing flushing gas from the hood through an oxide removal outlet located substantially opposite the flushing gas inlet and at a location in the vicinity of the surface of the molten metal bath to remove coating metal oxide vapors from the hood.

2. The method defined in claim 1 further comprising the step of removing coating metal oxide from gas withdrawn from the protective hood through the oxide removal outlet by passing the withdrawn gas through a filter trap effective in precipitation vapors of the coating metal oxide.

3. The method defined in claim 2 further comprising the steps of reintroducing the gas withdrawn through the oxide removal outlet into the protective hood through the flushing gas inlet after the coating metal oxide vapors have been removed.

4. The method defined in claim 3 wherein the step of reintroducing the withdrawn gas comprises providing a closed conduit circuit between the oxide removal outlet through the filter trap to the flushing gas inlet and introducing nitrogen gas under pressure into the conduit circuit between the filter trap and the flushing gas inlet in a direction to draw gas through the filter trap by an aspiration effect.

5. The method defined in claim 1 wherein the gas introduced into the protective hood through the inlet comprises nitrogen gas.

6. The method defined in claim 1 wherein the coating metal consists essentially of zinc.

7. The method defined in claim 1 wherein the coating metal comprises an alloy of zinc and aluminum.

8. The method defined in claim 1 further comprising the step of removing the coating metal oxide from the gas withdrawn through the oxide removal outlet by passing the withdrawn gas through a filter trap including an enclosed, substantially void precipitation chamber and a filter chamber containing a body of filter material effective in removing solid coating metal oxides entrained in the gas flowing therethrough, the withdrawn gas passing initially through the precipitation chamber and then through the filter mass, and subsequently reintroducing the filtered gas into the protective hood snout through the flushing gas inlet.

9. The method defined in claim 8 wherein the filter mass is a mass of steel wool.

10. The method defined in claim 9 wherein the step of reintroducing the withdrawn gas comprises providing a closed conduit circuit between the oxide removal outlet through the filter trap to the flushing gas outlet and introducing nitrogen gas under pressure into the conduit circuit between the filter trap and the flushing gas inlet in a direction to draw gas through the filter trap by an aspiration effect.

11. The method defined in claim 10 wherein the gas introduced into the protective hood through the inlet comprises nitrogen gas.

12. The method defined in claim 11 wherein the coating metal consists essentially of zinc.

13. The method defined in claim 11 wherein the coating metal comprises an alloy of zinc and aluminum.

14. In an apparatus for hot dip metal coating a running length of steel strip with a metal coating and including a furnace for cleaning and heat treating the strip moving therethrough, a molten bath of the coating metal, and a protective hood enclosing the steel strip between the furnace and the coating metal bath, the protective hood having a snout extending into the coating metal bath, the improvement comprising, coating metal oxide filter trap means for removing and retaining coating metal oxides entrained in a gas stream flowing therethrough, the filter trap having an inlet and an outlet, flushing gas inlet and outlet means in the protective hood snout above the surface of the molten coating metal bath, said flushing gas inlet and outlet means being located on opposite sides of said snout, first conduit means connecting the flushing gas outlet with the filter trap inlet, second conduit means connecting said flushing gas inlet with said filter trap outlet, and flow inducing means for inducing a flow of gas from said flushing gas outlet through said first conduit means, said filter trap, said second conduit means and said flushing gas inlet, the flow of gas induced by said flow inducing means and the location of said flushing gas inlet and outlet being such as to produce a flow of flushing gas across the surface of the molten metal bath within said snout on both sides of the strip in a direction generally parallel to its face surfaces and transverse to its direction of movement to sweep zinc oxide vapor from the snout and into the filter trap for removal.

15. The apparatus defined in claim 14 wherein said filter trap means comprises a closed housing defining a settling chamber adjacent its inlet and a body of filter material adjacent its outlet whereby vaporous coating metal oxides may precipitate as solids in the settling chamber and any precipitated solids entrained in the gas flowing through the filter trap will be removed by said filter body.

16. The method defined in claim 15 wherein said flow inducing means comprises aspirator means connected in said second conduit means, and means supplying gas under pressure to said aspiratior means in a direction to create a suction in said second conduit means to induce a flow through said filter trap from said first conduit means.

17. The method defined in claim 16 wherein said filter trap means comprises a closed housing defining a settling chamber adjacent its inlet and a body of filter material adjacent its outlet whereby vaporous coating metal oxides may precipitate as solids in the settling chamber and any precipitated solids entrained in the gas flowing through the filter trap will be removed by said filter body.

* * * * *